United States Patent [19]

Burk

[11] 4,389,022

[45] Jun. 21, 1983

[54] ROCK CRUSHER BREAKER BLOCKS AND ADJUSTMENT APPARATUS

[76] Inventor: John H. Burk, 712 Charlton Dr., Pleasant Hill, Calif. 94523

[21] Appl. No.: 270,336

[22] Filed: Jun. 4, 1981

[51] Int. Cl.[3] ..... B02C 13/09

[52] U.S. Cl. ..... 241/275

[58] Field of Search ..... 241/275, 299, 300

[56] References Cited

U.S. PATENT DOCUMENTS

| | | | |
|---|---|---|---|
| Re. 29,798 | 10/1978 | Johnson . | |
| 1,857,539 | 5/1932 | Hadsel . | |
| 2,357,843 | 9/1944 | Morrissey . | |
| 2,867,387 | 1/1959 | Dodds et al. . | |
| 2,981,490 | 4/1961 | Conley . | |
| 2,991,949 | 7/1961 | Sellars . | |
| 2,992,783 | 7/1961 | Wirth et al. . | |
| 2,992,784 | 7/1961 | Behnke et al. . | |
| 3,044,720 | 7/1962 | Bridgewater . | |
| 3,058,679 | 10/1962 | Adams . | |
| 3,074,657 | 1/1963 | Bridgewater . | |
| 3,088,685 | 5/1963 | Bridgewater . | |
| 3,093,329 | 6/1963 | Bridgewater . | |
| 3,110,449 | 11/1963 | Bridgewater . | |
| 3,148,840 | 9/1964 | Behnke . | |
| 3,150,838 | 9/1964 | Adams . | |
| 3,155,326 | 11/1964 | Rhodes . | |
| 3,168,991 | 2/1965 | Herman . | |
| 3,174,698 | 3/1965 | Miller . | |
| 3,204,882 | 9/1965 | Vifian et al. . | |
| 3,300,152 | 1/1967 | Behnke et al. . | |
| 3,334,823 | 8/1967 | Behnke et al. . | |
| 3,474,974 | 10/1969 | Wood . | |
| 3,540,667 | 11/1970 | Parker . | |
| 3,847,358 | 11/1974 | Lowe et al. | 241/275 X |
| 3,873,047 | 3/1975 | Johnson . | |
| 4,065,063 | 12/1977 | Johnson . | |
| 4,090,673 | 5/1978 | Ackers . | |
| 4,126,280 | 11/1978 | Burk . | |

*Primary Examiner*—Howard N. Goldberg

*Attorney, Agent, or Firm*—James R. Cypher

[57] ABSTRACT

A breaker block, radial and rotational breaker block adjustment assembly and vertical adjustment means for rock crushers having an impeller mounted on a vertical axis. The breaker blocks are mounted in cell members forming a concentric circle about the vertical axis. The breaker blocks are detachably connected to adjustment assemblies which move the blocks toward the impeller as they wear and permit rotation if the impact face wears unevenly. An annular ring in one form of the invention supports the breaker blocks and cell members and is movable vertically in relation to the impeller.

6 Claims, 9 Drawing Figures

ROCK CRUSHER BREAKER BLOCKS AND ADJUSTMENT APPARATUS

BACKGROUND OF THE INVENTION

This invention relates to rock crushers and more specifically to the crushing blocks in impact crushers having vertical shaft impellers.

The need for crushing rock on a large scale probably dates back to the time of the Persians who had a formidable empire during the 500 years proceeding the Christian era and needed roads to transport their amines from Asia Minor to India. Later, the Romans built over 50,000 miles of roads at the height of their imperial power.

It is doubtful whether either the Persians or Romans used any type of rock crushing machines even though rocks of fairly small uniform size were a major element in the design.

The earliest machines used to crush rock were probably tilt-hammers which were driven by water and later by steam engines. Tilt-hammers were in use at least as early as the mid-seventeen hundreds but steam engines to drive these tilt-hammers did not come into use until the mid-eighteen hundreds.

The earliest use of a rotating wheel spinning on a vertical axis to propel rock against a hard surface is unknown. Potter's wheels with vertical shafts have been found which date back to about 3,500 B.C. but Applicant's first knowledge of vertical shaft rock impellers is the Hadsel centrifugal rock crusher, U.S. Pat. No. 1,857,539 granted in 1932.

A primary problem in all impact crushers is the severe abrasion to the impact portions of the crusher. This abrasion is so rapid that some crushers can only be operated a few hours before adjustments or even replacement of the blocks must be made. These adjustments and replacements must be made quickly, easily and inexpensively or the crusher will be too costly to operate.

Hadsel discloses breaker blocks which were hung on hooks around the periphery of the wheel but the blocks did not have any radial adjustment to vary the distance the rock was thrown before striking the breaker blocks. Rotational adjustment to present a different portion of the face of the block to obtain evenness of wear was possible but the adjustment could not be made from outside the machine.

Morrissey, U.S. Pat. No. 2,357,843 disclosed a sectional breaker ring which could not be adjusted radially, vertically or rotationally.

Dodds, U.S. Pat. No. 2,867,387 discloses a plurality of impact targets formed of ceramic material in cylindrical collars. No radial or vertical adjustment was provided.

Conley, U.S. Pat. No. 2,981,490 discloses target impacters similar to Dodds and also fails to disclose any radial or vertical adjustment.

Sellars, U.S. Pat. No. 2,991,949 utilized flat breaker surfaces mounted on a circular sectional liner but disclosed no radial, vertical or rotational adjustment of the flat breaker surfaces.

Wirth, U.S. Pat. No. 2,992,783 discloses a bowl liner formed in sections to serve as crushing blocks. No radial, vertical or rotational adjustment is shown.

Behnke, U.S. Pat. No. 2,992,784 attempted to solve the wear problem of crushing blocks by providing shelves to retain crushed material so that the rocks were hurled against the crushed material. This system results in a great loss of energy since the crushed material in the shelves only seves to cushion the impact of the rocks to be crushed.

Bridgewater, U.S. Pat. No. 3,044,720 discloses a plurality of arcuate segmented breaker blocks pivotally mounted around the circumference of the impeller wheel. Each of the three arcuate segments may be pivoted by an adjustment bolt. While some radial adjustment is possible, there is no vertical or rotational adjustment.

Adams, U.S. Pat. No. 3,058,679 discloses a plurality of breaker plates but no radial, vertical or rotational adjustment from the breaker plates as wear progresses.

Bridgewater, U.S. Pat. No. 3,074,657 discloses a breaker plate structure with removable inserts but does not provide any radial or vertical adjustment. Rotational adjustment would be possible but relatively unimportant since the inserts appear to be very narrow.

Bridgewater, U.S. Pat. No. 3,088,685 discloses a plurality of removable breaker plates but there is no vertical or radial adjustment possible. The breaker inserts could be rotated 180° and reinserted but could not be rotated 90°.

Bridgewater, U.S. Pat. No. 3,093,329 discloses a plurality of serrated breaker plates which can not be adjusted radially or vertically. A 180° rotation of the breaker plates is possible but not a 90° rotation.

Bridgewater, U.S. Pat. No. 3,110,449 discloses breaker shoes with removable inserts but no radial or vertical adjustment. Some inserts may be rotated 180° but not 90°.

The Behnke crusher apparatus U.S. Pat. No. 3,148,840 discloses crusher blocks which can be rotated in 90° increments but can not be adjusted radially or vertically.

Adams, U.S. Pat. No. 3,150,838 uses breaker plates which can not be adjusted radially, vertically or rotationally.

Rhodes, U.S. Pat. No. 3,155,326 uses breaker plates which can not be adjusted radially, vertically or rotationally.

Herman, U.S. Pat. No. 3,168,991 discloses removable breaker segments which can not be adjusted radially, vertically or rotationally.

Miller, U.S. Pat. No. 3,174,698 discloses a plurality of breaker bars held in sockets but there is no radial, or vertical adjustment. It is possible to rotate the bars 90° and to invert the bars. None of these adjustments can be made from the outside of the rotary rock crusher.

Vifian, U.S. Pat. No. 3,204,882 discloses segmented breaker members which can not be adjusted vertically, radially or rotationally.

Behnke, U.S. Pat. No. 3,334,823 discloses a plurality of breaker blocks which can not be adjusted radially or vertically. The lid of the device must be removed in order to replace the breaker blocks.

Behnke, U.S. Pat. No. 3,300,152 discloses a plurality of breaker blocks pivotally mounted so that the angle at which the breaker intercepts the rocks to be broken can be adjusted. There is no radial, vertical or rotational adjustment possible.

Wood, U.S. Pat. No. 3,474,974 discloses breaker blocks made of at least (3) segments which are interchangeable so that if the central block receives more wear it can be interchanged with the upper or lower segment. No radial adjustment is possible although the segments can be rotated 180°. No adjustment is possible from the outside of the crusher.

Parker, U.S. Pat. No. 3,540,667 also shows segmented breaker blocks which can be interchanged or even rotated 180° but no radial or vertical adjustment is possible. All adjustments are made within the machine.

Johnson, in U.S. Pat. Nos. 3,873,047, 4,065,063 and Re. 29,798 recognized the uneven wear on the impact blocks and therefore provides for the reciprocating vertical movement of the entire assembly of breaking blocks on a timed sequence. Thus, rocks thrown from the impeller strike different parts of the breaker blocks along their vertical axis.

Ackers, U.S. Pat. No. 4,090,673 provides breaker blocks which have no radial or vertical adjustment but they can be rotated 180° to even the wear. Replacement is effected from inside the crusher.

Burk, U.S. Pat. No. 4,126,280 provided radial adjustment and rotation of the anvils 180 degrees only. No vertical adjustment was possible and all adjustments had to be made from inside the crushers. No adjustment of any kind could be made during operation of the crusher.

There are two schools of thought on whether rock is flung from the high speed rotating disk radially or tangentially. Ackers, exemplifies the tangential school and orients his breaker blocks so that the flat surface is at right angles to the tangent line from the periphery of the rotating impeller. On the other hand, Morrissey, supra provides a breaker ring which provides a surface at right angles to the radius from the center of the impeller. Since no one has yet looked inside an operating crusher to determine whether the trajectory of the rocks is tangential or radial, the debate continues. This application assumes that the trajectory is radial. Since both tangential and radial type crushers work whether the assumption is correct is not critical to the validity of the machine. To summarize the operation of the prior art rock crushers, while most of them are designed so that they have one or even two positional adjustments of the breaker blocks, none of them are designed so that adjustment of the block may be effected from outside the crusher, nor does any prior art crusher provide all three (3) of the major types of adjustment; namely, radial, vertically and rotationally.

SUMMARY OF THE INVENTION

The rock crusher of the present invention is designed so that the breaker blocks may be adjusted in all three (3) major aspects; namely, vertically, radially, and rotationally. Furthermore, all three (3) of these adjustments may be made from outside the crusher. Surprisingly, the radial adjustment may be made even while the crusher is fully operational and crushing rocks.

Radial adjustment may be made for each block to vary the distance from the impeller so that the impact force and consequently the amount of crushing may be regulated and this adjustment may be continued as the blocks wear during operation of the crusher. Since several inches of radial adjustment are possible, the length of time before total replacement of the block is required is greatly extended.

The blocks may be rotated in 90° increments either clockwise or counterclockwise without entering the machine. Since all operations may be made from outside the machine, the adjustment may be made more quickly and easily thus diminishing the down time of the crusher appreciably.

Vertical adjustment of the blocks may be accomplished to even the wear on the blocks if all of the blocks are wearing at the same elevation. Thus, the task of rotating the blocks one at a time may be eliminated. Further, if the impeller is throwing the rocks too low or too high, the vertical adjustment can be made to suit the throwing characteristics of the impeller or the throw elevation caused by rotation speed or the characteristics of the rock itself.

The adjustment mechanisms have been designed so that all portions of the adjustment mechanism are protected from the abrasive action of the crushing operation.

The ability to adjust the blocks in a radial direction permits fine adjustment of the location of the blocks around the periphery of the impeller so that they interlock and provide further radial support so that the mass of the breaker blocks are effectively increased. In other words, a rock striking the long breaker blocks is resisted by the mass of this block and the adjacent short blocks.

The radial adjustment and the use of short and long breaker blocks presents an overlapping impact surface which protects the crusher shell from damage by the rocks leaving the impeller at high velocity.

Since the adjustment mechanism is protected by the breaker block, it is not subject to wear and may be used for the life of the crusher itself.

The breaker blocks were sized so that they may be replaced and adjusted by one workman without the use of any mechanical lifting apparatus. Only a wrench is needed to make all adjustments.

The device is constructed so that it is nearly impossible to adjust the blocks incorrectly resulting in damage to the crusher or inefficient crushing of the material.

The longer wearing characteristics of the blocks made possible by the adjustments and the ease of adjustments themselves will result in an operational cost savings and because the adjustments may be made quickly, the crushing machine may be operated with less down time thereby increasing the productivity of the crusher.

DETAILED DESCRIPTION OF THE PREFERRED EMBODIMENT

Since the unique breaker blocks 1 and the adjustment means for adjusting the placement of the breaker blocks embody the inventive concepts of the present invention, the details of some portions of the rock crusher have not been disclosed or they are disclosed schematically. The construction of the impeller assembly 4 mounted on a vertical axis 5 is covered in my co-pending application, Ser. No. 06/284,471, filed: July 17, 1981 and the details of contruction are fully set forth therein.

Figure 7:
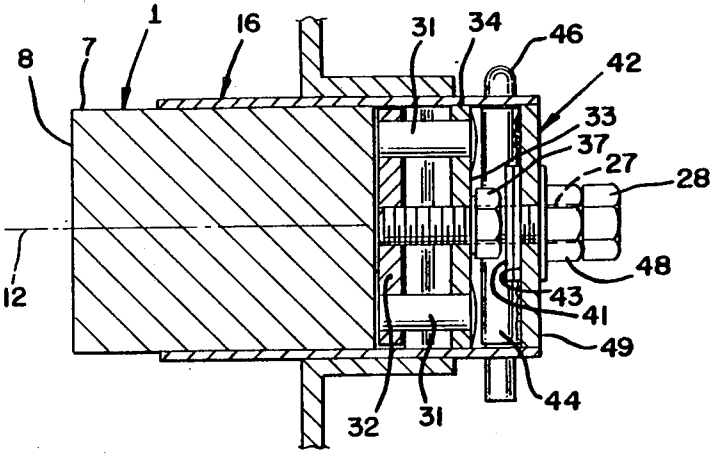
FIG. 7 is a cross sectional view of the breaker block and holding assembly taken along lines 7—7 of FIG. 2 illustrating the short block. The block as assembled is shown in the fully retracted position.
Figure 7A:
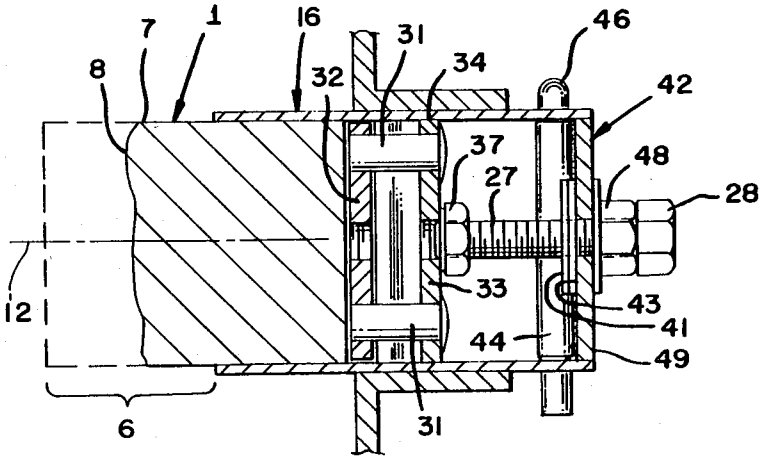
FIG. 7*a* is a cross section of the device shown in FIG. 7 in the fully extented position.
Figure 6:
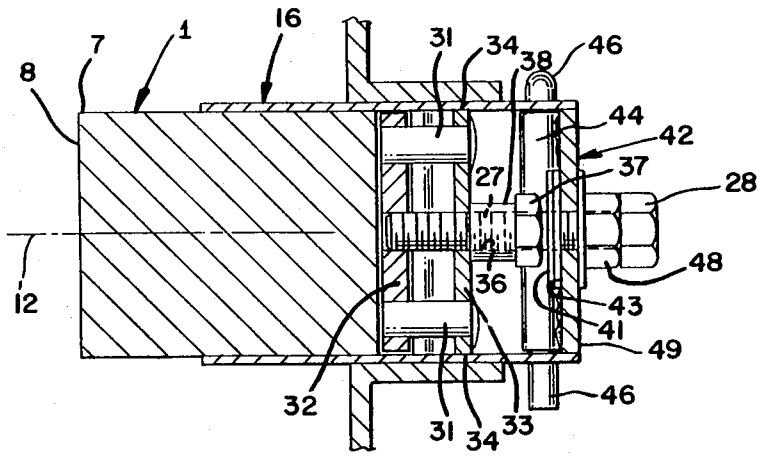
FIG. 6 is a cross sectional view of the breaker block and holding assembly taken along lines 6—6 of FIG. 2 illustrating the long block. The block as assembled is shown in the fully retracted position.
Figure 6A:
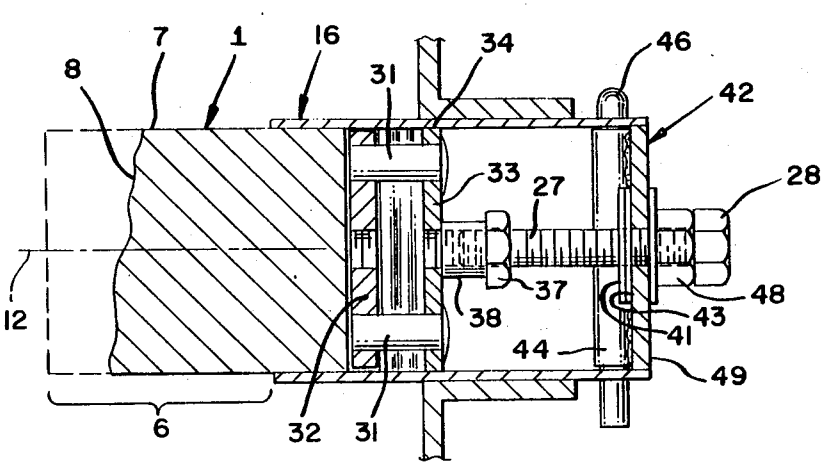
FIG. 6*a* is a cross section of the device shown in FIG. 6 in the fully extended position.

The breaker blocks have an impact portion 6 as indicated in FIGS. 6A and 7A with a distal end 7 forming an impact face 8 and a proximal portion 9 (See FIGS. 3 and 4) formed with an attachment means 11. The impact portion of the block has a longitudinal axis 12 and a length greater than its widest dimension. The impact portion has a transverse cross section which is symmetrical to the longitudinal axis forming an equal sided polygon which has a constant cross sectional area throughout its length.

The breaker blocks 1 could have a triangular or hexagonal cross section but preferably the cross section of the impact portion forms a square.

Figures 3, 4, 5:
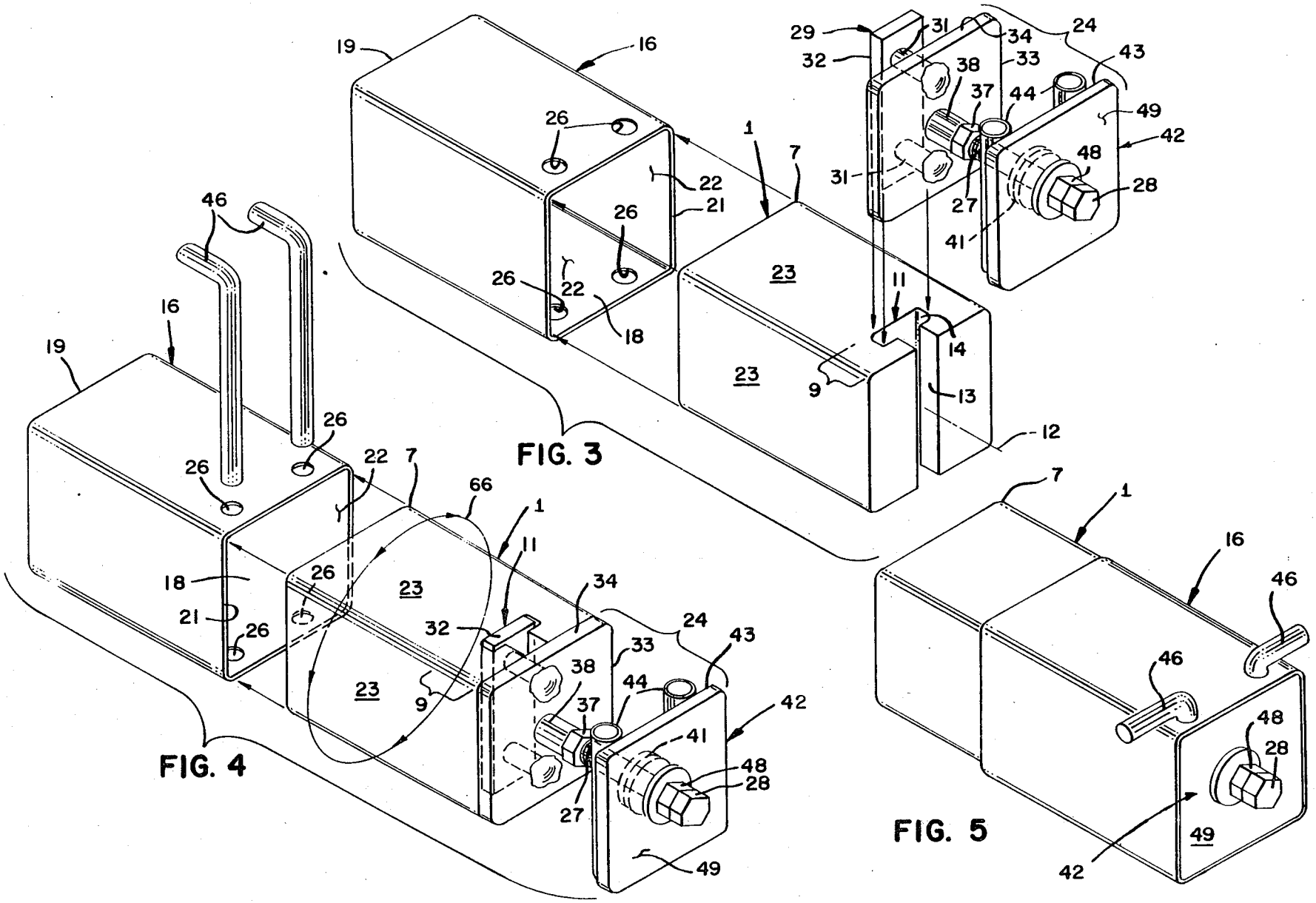
FIG. 3 is an exploded perspective view of a breaker block of the present invention and its holding assembly.
FIG. 4 is an exploded perspective view of the breaker block and assembly shown in FIG. 3 with portions of the invention assembled to more clearly illustrate the invention.
FIG. 5 is a perspective view of the breaker block and assembly of FIGS. 3 and 4 fully assembled.

The attachment means 11 may have various shapes and the keyway illustrated is only one of the many possible forms. Referring to FIG. 3, the keyway includes a proximal end slot 13 and an interconnected internal transverse slot 14.

A plurality of cell members 16 are connected to the housing 17 of the rock crusher. Each cell forms a chamber 18 which is open at a distal end 19 to the interior of the crusher and a proximal end 21 open to the exterior of the housing. Each cell has side walls 22 slidably registering with the side walls 23 of the breaker blocks.

An adjustment means releasably connected to the block attachment means 11 includes an adjustment assembly 24 for selectively adjusting the extension distance of the adjustment assembly thereby selectively adjusting the distance of the impact face 8 from the impeller 4. Opposite walls of the cell member are formed with rod openings 26.

The adjustment assembly 24 consists of a threaded bolt member 27 having a head 28 adapted for receiving a wrench for rotating the threaded bolt member. An arm means 29 is detachably connected to the block attachment means and here consists of pins 31 connected to a bar 32.

A traveler member 33 is connected to the pins of the arm means and has an edge 34 in sliding contact with the cell member wall to prevent rotation of the traveler member. The traveler member is formed with a threaded opening 36 therethrough. A preferred form of construction is to construct the traveler member from a square plate and to weld a threaded nut 37 to the face of the plate. In this form, the opening in the plate may be unthreaded and the internal threads of the nut 37 provide the threads for receiving the threaded bolt member 27. In the form of the invention shown in FIGS. 3, 4, 6 and 6A, an extension sleeve 38 is welded to the square plate and to the threaded nut 37.

A fixed abutment member 41 is connected to the rod member for rotation therewith and is spaced from the traveler member. The fixed abuttment may consist of a metal washer welded to the rod.

A cell attachment member 42 is slidably mounted on the rod and has an inner face 43 which is movable into and out of engagement with the fixed abutment member 41. A locking rod receiving member 44 is formed in or connected to the cell attachment member and may be simply constructed by welding a pair of sleeve members to the inside face.

The adjustment assembly and the breaker block are attached to the cell member by locking rod members 46 having an L-shape and dimensioned for insertion through openings 26 in the cell wall and locking rod receiving members 44.

A lock nut 48 is threadably mounted on the rod and is movable into and out of locking engagement with the outside face 49 of the cell attachment member to prevent rotation of the threaded rod in the locked position.

In the preferred form of the invention, the cell members 16 and the breaker blocks 1 are mounted radially of the impeller axis 5. Further, it is preferable to mount the cells and breaker blocks in two concentric rows with adjacent blocks in alternate rows. The breaker blocks which have their impact faces set along the inner concentric circle and initially set as shown in FIG. 6 are known as "long blocks." The breaker blocks which have their impact faces set along the outer concentric circle and initially set as shown in FIG. 7 are known as "short blocks."

The elevation at which the material to be crushed strikes the breaker blocks is dependent on such factors as speed of rotation of the impeller, size and shape of the material, weight of the material, condition of the impeller and other factors. While the rotation speed of the impeller can be varied in some crushers the other factors cannot be controlled. This causes uneven wear on the breaker blocks. While the adjustment means set forth above permits the breaker blocks to be rotated this does require that the machine be stopped and each individual block rotated. An efficient method of adjusting the evenness of the wear on the breaker blocks can be accomplished by constructing the crusher with an annular ring which is here illustrated as an annular L-shaped member 51 having a horizontal leg 52 upon which the breaker blocks rest and a vertical leg 53 formed with a plurality of circumferentially spaced vertical slots 54. The housing is formed with a plurality of circumferentially spaced bolt holes 56 which are dimensioned for receipt of bolts 57 therethrough. The threaded bolts receive threaded nut 58 and locking nut 59. An annular L-shaped member 61 is welded to the top walls of the cell members and a lid 62 is releasably held by threaded bolts 63 welded to the L-shaped member 61. The spaces between the cells may be filled with plate members 64.

In operation, the "long breaker blocks" are initially set as illustrated in FIG. 6. The breaker block is withdrawn into the cell as far as possible so that threaded nut 37 is in touching or nearly touching contact with fixed abutment member 41. This is accomplished by first rotating lock nut 48 counterclockwise so that it is released from cell attachment member 42. Next, nut 28 is rotated clockwise so that it draws traveler 33 toward cell attachment member 42. When the breaker block is fully withdrawn into cell member 16, lock nut 48 is rotated clockwise until it is snug against cell attachment member 42.

Figure 1:
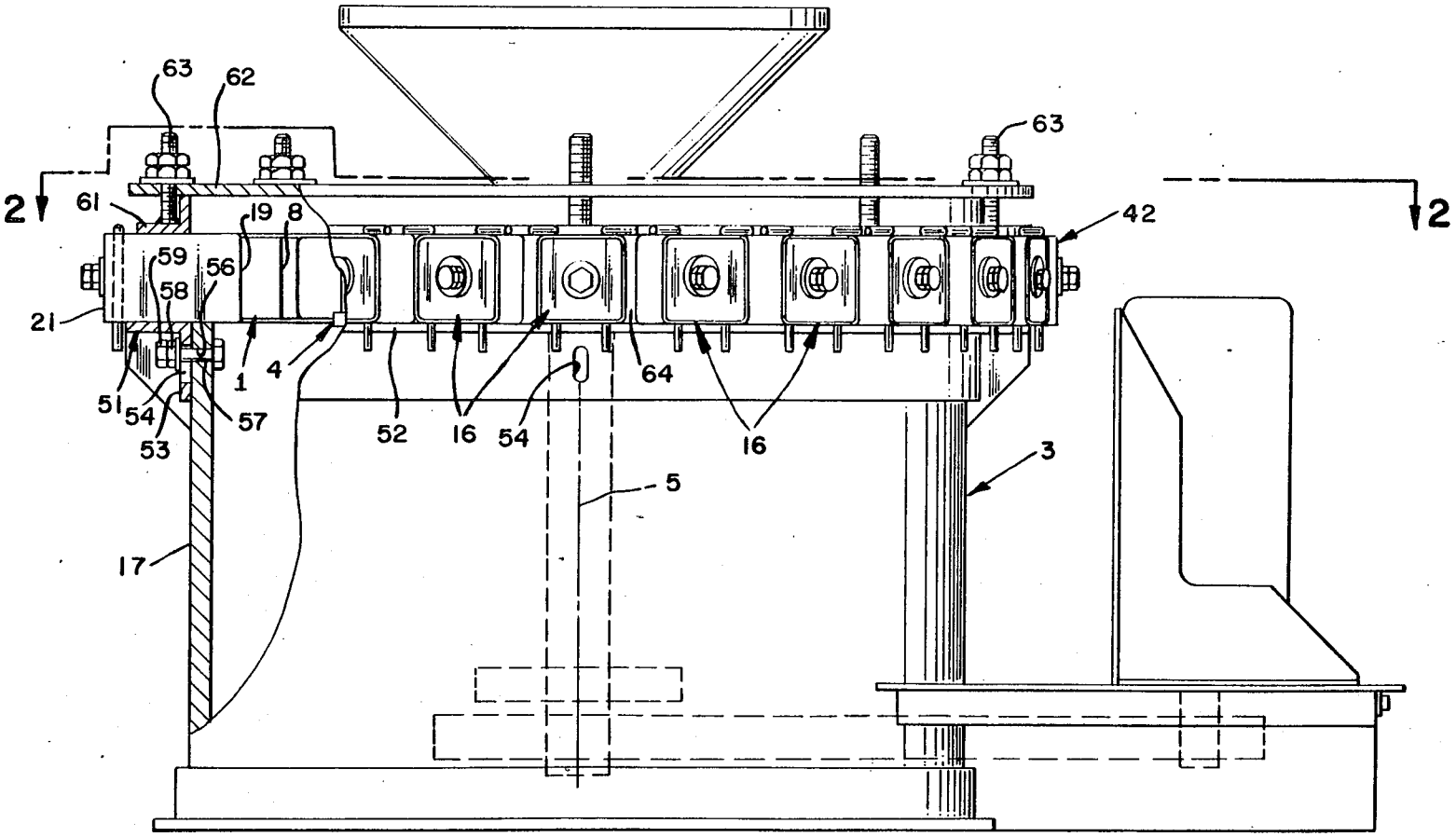
FIG. 1 is a side view of a rock crusher with a portion removed and in cross section to more clearly illustrate the present invention.
Figure 2:
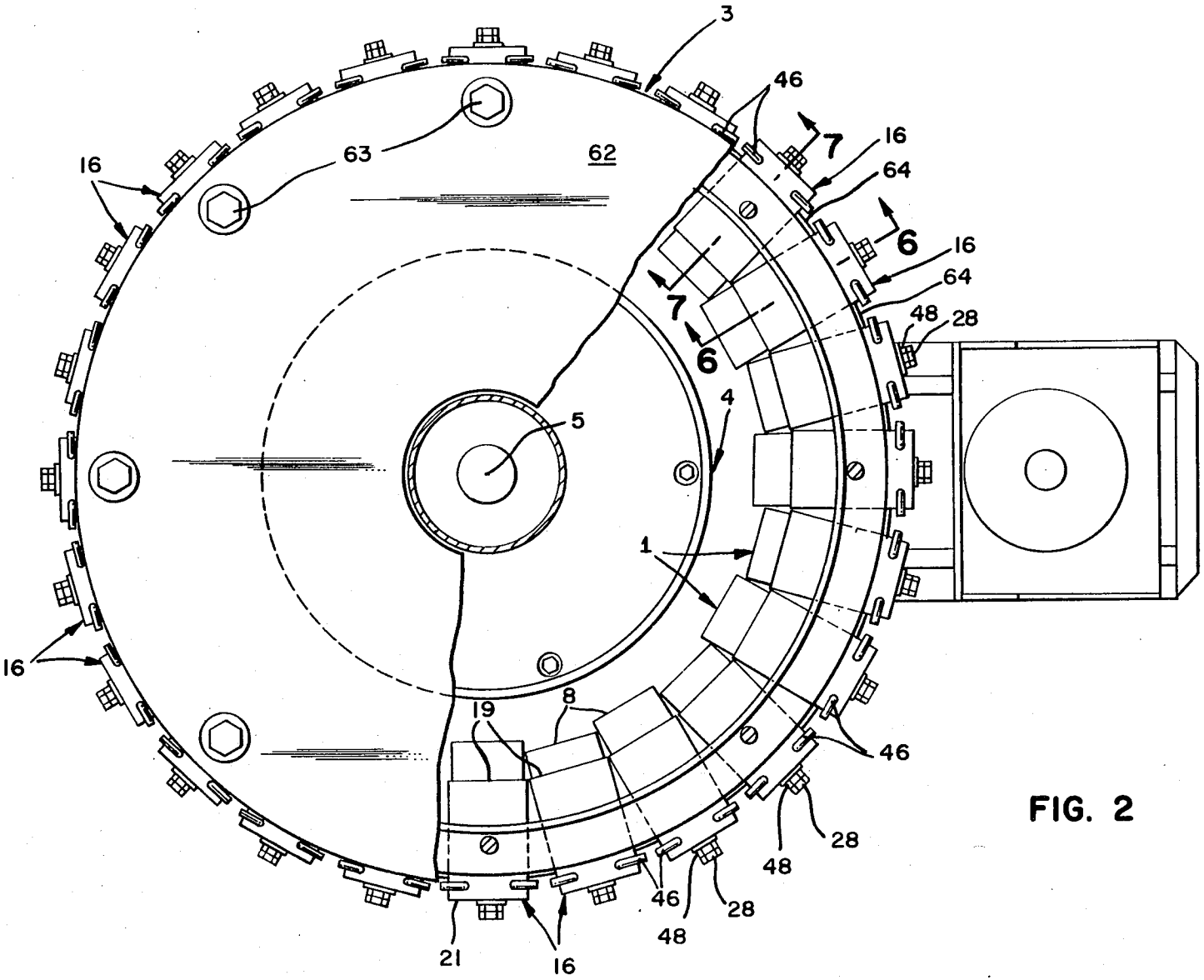
FIG. 2 is a top plan view of a crusher with a portion of the cover removed to illustrate the breaker blocks of the present invention taken generally along line 2—2 of FIG. 1.

The short breaker block is then positioned as shown in FIG. 7 using exactly the same method. After all of the breaker blocks are positioned, they form to concentric circles as shown in FIG. 2.

After the crusher has been in operation on a given type of material, the crusher is stopped and the impact faces 8 of the breaker blocks are inspected for wear. If it is seen that the same portion of each breaker block impact face is wearing, the entire annular ring 51 may be shifted upwardly or downwardly by loosening nuts 58 on threaded bolts 57 and then forcing the annular ring and all of the blocks upwardly or downwardly within the adjustment permitted within slots 54 in the vertical leg 53. The annular ring may be moved vertically with a crane, jack or jack screws attached to the wall of the housing 17.

If the crusher does not have an annular ring vertical adjustment or only some of the impact faces are wearing unevenly, then the breaker blocks may be rotated 90 degrees clockwise or counterclockwise or a full 180 degrees. Rotational adjustment, like the vertical adjustment of the annular ring is accomplished from outside the crusher housing 17. The locking rods 46 are withdrawn from locking rod receiving members 44 and the entire breaker block 1 and adjustment assembly 24 is rotated to the desired 90 degree increment. The adjustment assembly is not removed from the breaker block for rotational adjustment. Only the block and traveler member 33 is rotated 90 degrees if rotation is 180 degrees then the block and entire adjustment assembly 24 is rotated. Rotation is indicated by double arrow 66 illustrated in FIG. 4.

If the impact portion 6 of the block is substantially worn as illustrated in FIGS. 6A and 7A, then the breaker block is moved toward the impeller 4 as follows: The movement of the short and long blocks is identical. First, the lock nut 48 is rotated counterclockwise to release it from the face 49 of cell attachment member 42. Next, nut 28 is rotated counterclockwise to push block 1 toward the impeller 14. When the desired extension is reached, lock nut 48 is rotated clockwise until tight. Note that movement of the crushing blocks radially can even be accomplished while the crusher is in operation and crushing rock.

When the crushing blocks are completely worn and need to be replaced, the impeller is stopped and the locking rods 46 are removed. The entire worn block and adjustment assembly 24 are removed from the cell. The block is removed from the adjustment assembly by simply slipping the bar 32 out of internal slot 14 in the block. A new breaker block is slipped into bar 32 and the breaker block and assembly are mounted in the cell as above described.

I claim:

1. In a rock crusher having a housing (17) and an impeller (4) mounted on a vertical axis (5) the improvement comprising:

a. a plurality of breaker blocks (1) surrounding said impeller and each breaker block having a longitudinal axis (12), an impact portion (6) with a distal end (7) forming an impact face (8), a proximal portion (9) and side walls (23); said impact portion has a transverse across section which is symmetrical to said longitudinal axis and which forms an equal sided polygon and which has a constant cross sectional area throughout its length and attachment means (11) formed in said proximal portion;

b. a plurality of cell members (16) connected to said housing forming a chamber (18) open at its distal end (19) to the interior of said crusher and the proximal end (21) is open to the exterior of said housing;

c. each of said cell members having walls (22) slidably registering with said side walls (23) of said breaker blocks; and d. an adjustment means releasably connected to said attachment means (11) in said proximal portion.

2. In a rock crusher as described in claim 1 wherein:

a. said breaker block is formed with a square cross section; and b. said block attachment means formed in said block is an internal slot (14) formed in said proximal end of said block running transversely to said block axis and an interconnecting proximal end slot (13).

3. In a rock crusher as described in claim 1 comprising:

a. said adjustment means includes an adjustment assembly (24) for selectively adjusting the extension distance of said adjustment assembly thereby selectively adjusting the distance of said impact face of said block from said impeller; and b. said wall of said cell member is formed with a rod opening (26).

4. In a rock crusher as described in claim 3 wherein said adjustment assembly comprises:

a. a threaded bolt member (27) having a turning member (28) for rotating said threaded bolt member;

b. an arm means (29) for detachable interconnection with said block attachment means;

c. a traveler member (33) connected to said arm means and having an edge (34) in sliding contact with said cell member to prevent rotation of said traveler member and formed with a threaded opening (36) therethrough for threadably receiving said bolt member;

d. a fixed abutment member (41) connected to said bolt member for rotation therewith and spaced from said traveler member;

e. a cell attachment member (42) slidably mounted on said bolt member and having an inner face (43) movable into and out of engagement with said fixed abutment member and formed with a locking rod receiving member (44) and having an outside face (49);

f. a locking rod member (46) dimensioned for receipt through said opening in said wall of said cell member and into locking engagement with said locking rod receiving member of said cell attachment member; and g. a lock nut (48) threadably mounted on said bolt member movable into and out of locking engagement with said outside face (49) of said cell attachment member for drawing said fixed abutment member into frictional engagement with said inner face of said cell attachment member to prevent rotation of said threaded bolt member in the locked position.

5. In a rock crusher as described in claim 4 wherein:

a. said cell members are mounted radially of said vertical axis of said crusher.

6. In a rock crusher as described in claim 5 comprising:

a. said plurality of breaker blocks are disposed in two concentric rows with adjacent blocks in alternate rows.

* * * * *